US009004180B2

(12) United States Patent
Jackson

(10) Patent No.: US 9,004,180 B2
(45) Date of Patent: Apr. 14, 2015

(54) METHOD AND APPARATUS FOR ACTUATING A DOWNHOLE TOOL

(75) Inventor: Stephen L. Jackson, Richmond, TX (US)

(73) Assignee: Team Oil Tools, L.P., The Woodlands, TX (US)

( * ) Notice: Subject to any disclaimer, the term of this patent is extended or adjusted under 35 U.S.C. 154(b) by 341 days.

(21) Appl. No.: 13/425,413

(22) Filed: Mar. 20, 2012

(65) Prior Publication Data

US 2013/0248201 A1 Sep. 26, 2013

(51) Int. Cl.
*E21B 34/14* (2006.01)
*E21B 23/00* (2006.01)

(52) U.S. Cl.
CPC ..... *E21B 34/14* (2013.01); *E21B 23/006* (2013.01)

(58) Field of Classification Search
USPC ..... 166/373, 383, 386, 318, 331, 177.5
See application file for complete search history.

(56) References Cited

U.S. PATENT DOCUMENTS

| | | | | |
|---|---|---|---|---|
| 8,479,822 | B2 | 7/2013 | Hofman et al. | |
| 8,540,019 | B2 | 9/2013 | Hofman et al. | |
| 2009/0308588 | A1 * | 12/2009 | Howell et al. | 166/66.4 |
| 2011/0278017 | A1 * | 11/2011 | Themig et al. | 166/373 |

* cited by examiner

*Primary Examiner* — Cathleen Hutchins
(74) *Attorney, Agent, or Firm* — MH2 Technology Law Group, LLP

(57) ABSTRACT

Apparatuses and methods used for actuating downhole tools in which a ball is dropped from a surface of a wellbore until it contacts a ball seat of a downhole tool. The ball seat moves axially downward within the downhole tool and an expandable ball seating surface of the ball seat radially expands to pass the ball. The ball seat then moves axially upward within the downhole tool.

20 Claims, 7 Drawing Sheets

METHOD AND APPARATUS FOR ACTUATING A DOWNHOLE TOOL

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of the Invention

Embodiments disclosed herein relate to apparatuses and methods used in downhole tools. More specifically, embodiments disclosed herein relate to apparatuses and methods used in actuating downhole tools. More specifically still, embodiments disclosed herein relate to apparatuses and methods used in the actuation of multiple downhole tools during sequenced operations, such as hydraulic fracturing operations.

2. Background Art

This section of this document introduces various information from the art that may be related to or provide context for some aspects of the technique described herein and/or claimed below. It provides background information to facilitate a better understanding of that which is disclosed herein. This is a discussion of "related" art. That such art, is related in no way implies that it is also "prior" art. The related art may or may not be prior art. The discussion in this section is to be read in this light, and not as admissions of prior art.

Prior to producing or in order to further stimulate the production of hydrocarbons from underground reservoir rock formation, a well may be fractured through a process known in the art as hydraulic fracturing, hydrofracing or fracing. Hydraulic fracturing involves the propagation of fractures in formation caused by pumping pressurized fluid from the surface of a well. Examples of fluids that may be used in hydraulic fracturing operations include combinations of water, proppants, and chemical additives in the form of liquids, gels, foams, and gas. Examples of gases that may be injected include compressed nitrogen, carbon dioxide, and air. By hydraulically fracturing a well a greater rate of production of hydrocarbons may be achieved.

As wells may be thousands of feet long, it is often necessary to conduct multiple hydraulic fracturing operations, for example, every several hundred feet, in order to increase the production of hydrocarbons from the well. In order to hydraulically fracture the well at multiple locations, a series of valves may be run downhole and set at specific depths within the well. In conventional downhole valves used in multiple hydraulic fracturing operations, multiple valves are run to specific depths within the well that open within one given stage, for example, with one ball size. The valves have expandable sleeves, such that when a ball is dropped from the surface and pushed downward within the well by pressure from above, a sleeve under a ball seat of the valve opens. After opening, the ball seat expands and the ball is allowed to continue down to the next expandable sleeve.

The process may then repeat itself, so long as the ball remains structurally intact. The ability of this process to be effective is limited by the strength of the ball used, as well as the interference between the ball and the ball seat necessary to withstand the differential pressure during the hydraulic fracturing process. Presently, ball drop systems used in hydraulic fracturing processes are limited to about 23 actuation cycles for a 4.5 inch system and about 28 actuation cycles for a 5.5 inch system. As well are drilled deeper to access deeper hydrocarbon reserves, more hydraulic fracturing stages are required in order to properly hydraulically fracture a well.

Such conventional systems also are not proven to create separate fractures with any reliability. In such systems, pumping fracturing fluids down the well with multiple valves open at once has not improved the number or productivity of the fractures, thereby wasting time, money, and fluids, without seeing a return on investment.

SUMMARY OF THE DISCLOSURE

In a first aspect, there is a downhole tool comprising: an outer housing having a plurality of housing ports; an inner mandrel disposed in the outer housing, the inner mandrel having a plurality of mandrel ports; and a ball seat disposed in the inner mandrel, the ball seat comprising an expandable ball seating surface and a jay slot.

In a second aspect, a method of actuating a downhole tool, the method comprises: dropping a ball from a surface of a wellbore; contacting the ball with a ball seat of the downhole tool; moving the ball seat axially downward within the downhole tool; expanding radially an expandable ball seating surface of the ball seat; passing the ball through the expanded expandable ball seating surface; and moving the ball seat axially upward within the downhole tool.

In a third aspect, a method of fracturing formation comprises: disposing a first downhole tool to a first location within a wellbore, wherein the first downhole tool comprises a ball seat having a first diameter; disposing a second downhole tool to a second location within the wellbore, wherein the second downhole tool comprises an expandable ball seat having the first diameter; dropping a first ball from a surface of the wellbore; passing the first ball through the second downhole tool; seating the first ball in the ball seat of the first downhole tool; opening a plurality of ports in the first downhole tool; dropping a second ball from the surface of the wellbore; seating the second ball in the expandable ball seat of the second downhole tool; opening a plurality of ports in the second downhole tool; and fracturing the formation.

The above presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

BRIEF DESCRIPTION OF DRAWINGS

The claims set forth below may be understood by reference to the following description taken in conjunction with the accompanying drawings, in which like reference numerals identify like elements, and in which:

While the claimed subject matter is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

In one aspect, embodiments disclosed herein relate to apparatuses and methods used in downhole tools. In certain aspects, embodiments disclosed herein relate to apparatuses and methods used in actuating downhole tools. In further aspects, embodiments disclosed herein relate to apparatuses and methods used in the actuation of multiple downhole tools during sequenced operations, such as hydraulic fracturing operations.

Embodiments of the present disclosure may increase the efficiency of hydraulic fracturing operations by allowing a greater number of discrete frac stages to be segregated and individually fractured within a given well. The valve of the present disclosure uses a ball seat having a repeating jay slot and an expandable ball seating surface to allow balls of varying diameter to pass through the valve, only actuating a final valve within a specified ball seat range. Those of ordinary skill in the art will appreciate that while this actuation system is discussed in detail for the actuation of hydraulic fracturing tools, such as valves, the actuation system may be used in various other downhole tools.

Figure 1:
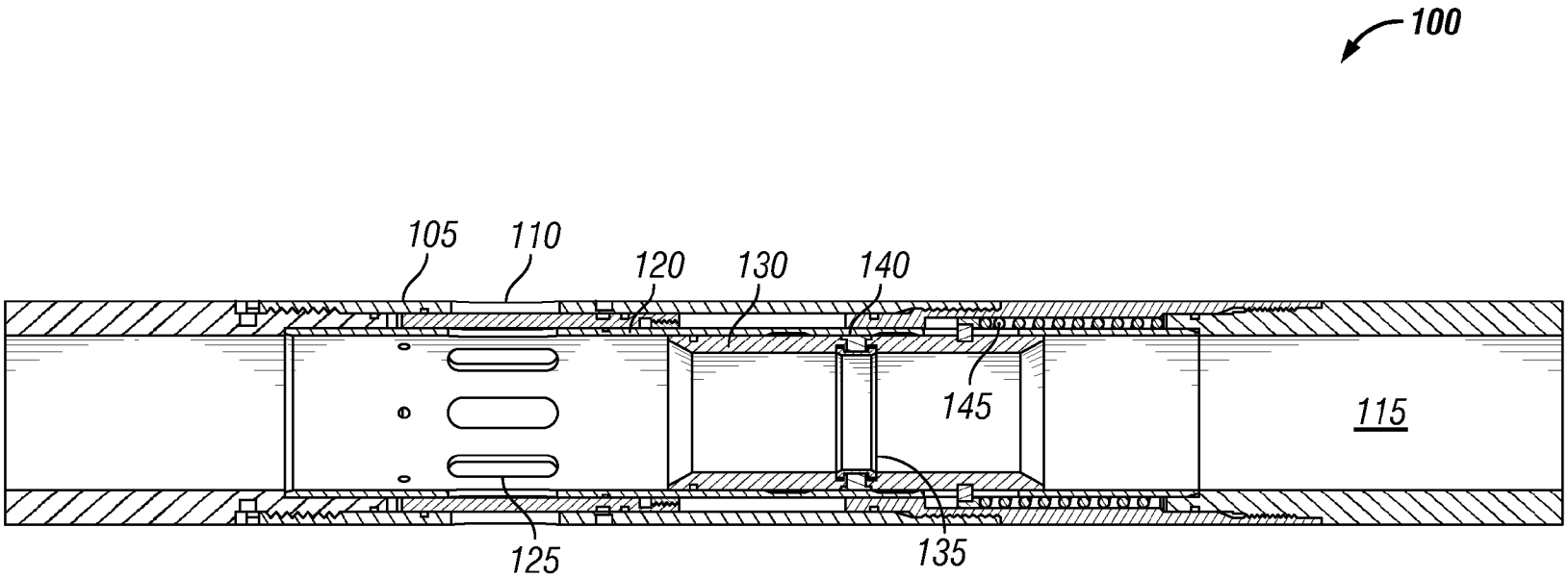
FIG. 1 is a cross-sectional view of a downhole tool according to embodiments of the present disclosure.

Referring to FIG. 1, a cross-sectional view of a downhole tool according to embodiments of the present disclosure is shown. In this embodiment, downhole tool 100 is a fracture valve used in hydraulic fracturing operation. However, in alternate embodiments, the actuation system of downhole tool 100 may be used in various other downhole tools that employ a ball drop actuation system.

As illustrated, downhole tool 100 has an outer housing 105 that includes a plurality of housing ports 110. Outer housing 105 may be formed from various materials including metals, metal alloys, and composites. Housing ports 110 provide fluid communication between a central flow bore 115 of downhole tool 100 and the wellbore (not independently shown). Thus, when downhole tool 100 is in the open position, fluid may flow from the central flow bore 115 into the well, or fluids may be produced from the well in central flow bore 115. Those of ordinary skill in the art will appreciate that housing ports 110 may be of various size and geometry depending on constraints of the particular downhole tool 100 or operation in which downhole tool 100 is used.

Downhole tool 100 also has an inner mandrel 120 disposed within outer housing 105. Inner mandrel 120 may also be formed from various materials including metals, metal alloys, and/or composites. Inner mandrel 120 is configured to rotate within outer housing 105, thereby allowing downhole 100 to be actuated from a closed position (as shown), into an open, or frac ready position, which is discussed in greater detail below. Inner mandrel includes a plurality of mandrel ports 125 that when downhole tool 100 is in an open position, align with housing ports 110 of housing 105 to allow fluid communication between central flow bore 115 and the wellbore, as described above. As with the housing ports 110, mandrel ports 125 may be of various size and geometry as required by the operational conditions.

Downhole tool 100 further includes a ball seat 130 disposed within inner mandrel 120. Ball seat 130 may be formed from various materials including metals, metal alloys, and composites. Ball seat 130 is configured to slide within inner mandrel 120 during actuation of downhole tool 100. An expandable ball seating surface 135 extends radially within ball seat 135. Ball seat 130 is configured to rotate within inner mandrel 120 on one or more pins 140, which slide within a ball seat jay slot (not shown). Expandable ball seating surface 135 is biased in a closed position with one or more springs, such as power springs 145. A particular configuration of ball seat 130 and expandable ball seating surface 135 that may be used in one or more embodiments of downhole tool 100 is discussed in detail below.

Figure 2:
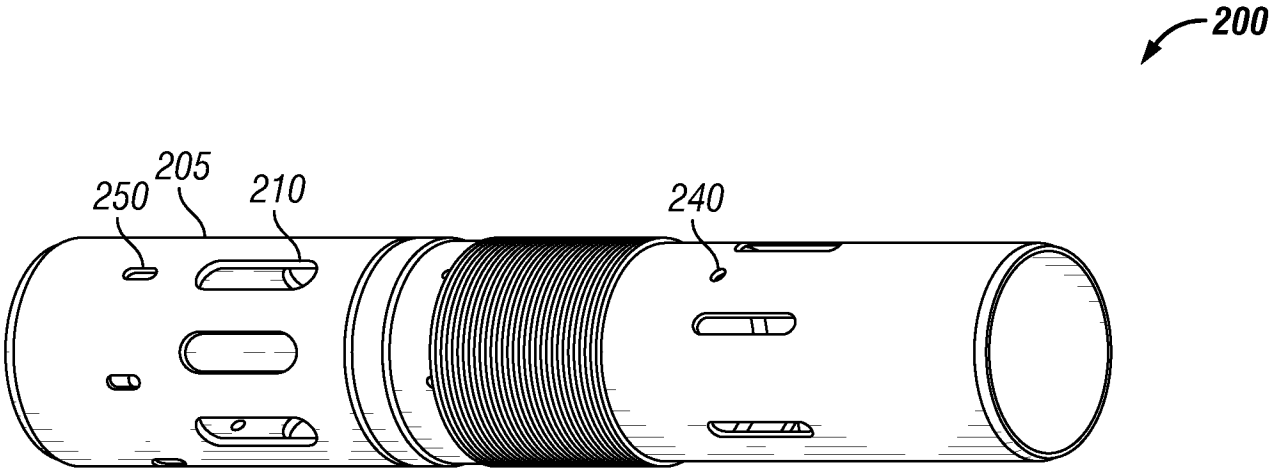
FIG. 2 is a side perspective view of a downhole tool according to embodiments of the present disclosure.

Referring to FIG. 2, a side perspective view of downhole tool 200 according to embodiments of the present disclosure is shown. In this embodiment, downhole tool 200 is illustrated including an inner mandrel 205 having a plurality of mandrel ports 210. Downhole tool 200 further includes a plurality of pins 250 that keep the plurality of housing ports and the plurality of inner mandrel ports 210 in alignment when downhole tool 200 is actuated. Downhole tool 200 further includes one or more pins 240, which are configured to rotate within a jay slot (not illustrated), which will be described in detail below.

Figure 3:
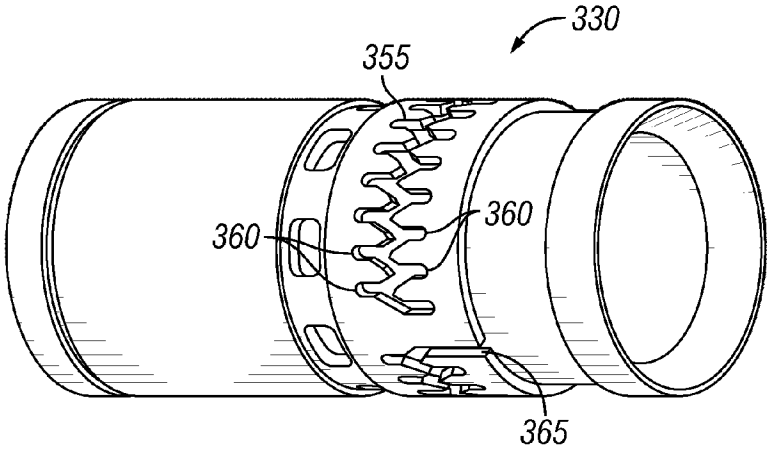
FIG. 3 is a side perspective view of a ball seat according, to embodiments of the present disclosure.

Referring to FIG. 3, a side perspective view of a ball seat 330 according to embodiments of the present disclosure is shown. In this embodiment, ball seat 330 is illustrated having a repeating jay slot 355 machined into the outer surface of ball seat 330. Repeating jay slot 355 includes a plurality of slot positions 360 that allow ball seat 330 to slide within an inner mandrel (not shown) of a downhole tool, as discussed above. One or more pins (not shown) of the downhole tool extend from outer housing (not shown), through inner mandrel (not shown), and into repeating jay slot 355. During one or more actuation cycles, the one or more pins may cause ball seat 330 to rotate as the pin slides between the various slot positions 360. The number of slot positions 360 may vary depending on the requirements of the operation. As shown, ball seat 330 includes eleven slot positions, however, in other embodiments, ball seat 330 may include two to ten slot positions 330, or, more than eleven slot positions, for example, twelve to twenty slot positions 360. Those of ordinary skill in the art will appreciate that the number of slot positions 360 may vary based on the materials used in forming ball seat 330 and/or operational conditions.

Ball seat 330 also includes a final slot position 365. Final slot position 365 is an open position that allows the one or more pins to exit the repeating jay slot 355. Upon exiting the repeating jay slot 355, one or more locks (not shown), such as a wicker, may engage ball seat 330, thereby preventing ball seat 330 from sliding in an axial downhole direction. In certain embodiments, engagement of one ore more locks may prevent the ball seat 330 from moving axially downward, but may not restrict ball seat 330 from moving axially upward.

Figure 4:
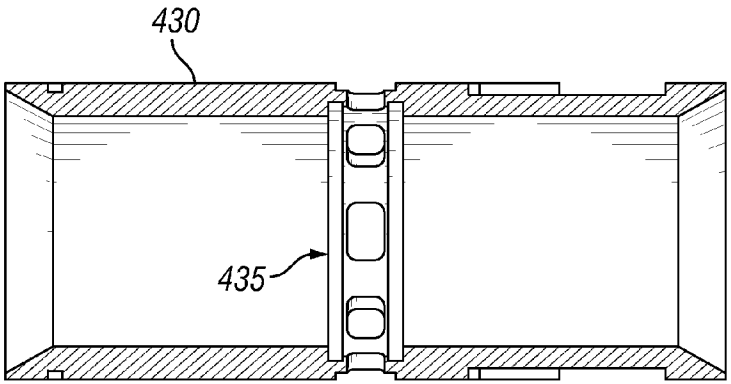
FIG. 4 is a cross-sectional view of a ball seat according to embodiments of the present disclosure.

Referring to FIG. 4, a cross-sectional view of a ball seat 430 according to embodiments of the present disclosure is shown. In this embodiment, ball seat 430 includes an expandable ball seating surface 435. Expandable ball seating surface 435 provides a restriction within ball seat 430 onto which a ball (not shown) dropped from the surface of the wellbore may seat. As ball seat 430 slides axially downward within inner mandrel (not shown) of a downhole tool, the expandable ball seating surface 435 may radially expand, thereby allowing a ball to pass through ball seat 430. One or more springs (not shown), may then push ball seat 430 axially upward causing expandable ball seating surface 435 into a closed position, in which the expandable ball seating surface 435 creates a restriction in the central flow borer of the downhole tool.

Figure 5:
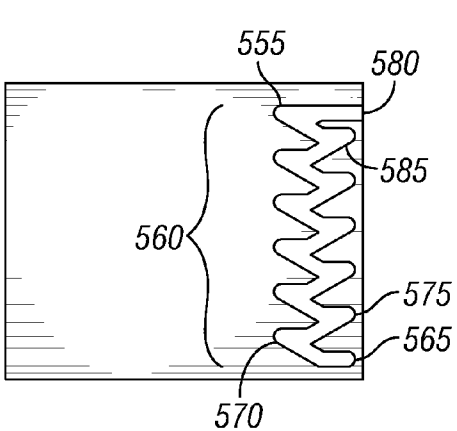
FIG. 5 is a schematic representation of a repeating jay slot according to embodiments of the present disclosure.

Referring to FIG. 5, a schematic representation of a repeating jay slot 555 according to embodiments of the present disclosure is shown. In this embodiment, repeating jay slot 555 includes twelve different slot positions 560, which correspond to six rotations of a ball seat (not shown) within an inner mandrel (not shown) of a downhole tool. Initially, the one or more pins (not shown) may start at a first position 565, when a downhole tool is run in hole. As a first ball (not shown), of sufficient diameter to push down on a expandable ball seating surface (not shown), is dropped from the surface of the wellbore the ball seat slides axially downward within the inner mandrel (not shown) and the one or more pins slide into a second slot position 570. After the ball passes through the ball seat, one or more springs (not shown) push the ball seat axially upward and the one or more pins slide along repeating jay slot 555 into a third slot position 575. The one or more pins may continue to slide through repeating jay slot 555 until the pin exits final slot position 580. When the one or more pins exit final slot position 580, the ball seat may be prevented from moving axially downward though a lock or wicker, as described above.

As explained in detail above, the number of slot positions may vary based on the requirements of the downhole operations. In some embodiments, it may be beneficial to have more slot positions 560, thereby allowing more downhole tools to be independently actuated. In certain embodiments, such as when less tools are being used, or less cycles are required, the downhole tool may be preset to require fewer cycles. For example, the one or more pins do not have to start at first slot position 565. If fewer cycles are required, the pin could be placed in any slot position 560 to start, thereby requiring fewer ball drops to actuate the downhole tool. For example, the pin could start at slot position eleven 585, such that two ball drops would actuate the downhole tool. Presetting a downhole tool by adjusting the pin position within the repeating jay slot 555 may be useful when ball seats have repeating jay slots 555 having numerous slot positions 560.

Figure 6:
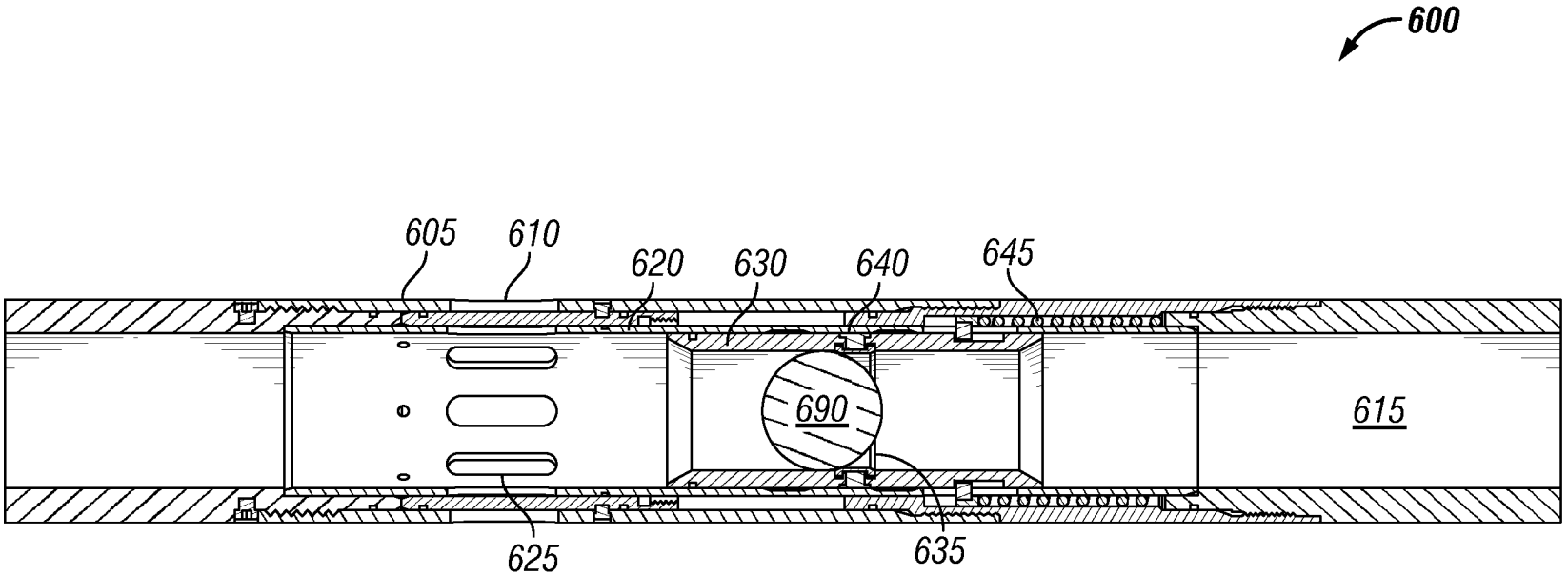
FIG. 6 is a cross-sectional view of a downhole tool according to embodiments of the present disclosure.

Referring to FIG. 6, a cross-sectional view of a downhole tool 600 according to embodiments of the present disclosure is shown. In this embodiment, downhole tool 600 is shown during a ball drop, as a ball initially engages a ball seat.

Downhole tool 600 has an outer housing 605 that includes a plurality of housing ports 610. Housing ports 610 provide fluid communication between a central flow bore 615 of downhole tool 600 and the wellbore (not independently shown). Downhole tool 600 also has an inner mandrel 620 disposed within outer housing 605. Inner mandrel 620 is configured to rotate within outer housing 605, thereby allowing downhole tool 600 to be actuated from a closed position (as shown), into an open, or frac ready position. Inner mandrel includes a plurality of mandrel ports 625 that when downhole tool 600 is in an open position, align with housing ports 610 of housing 605 to allow fluid communication between central flow bore 615 and the wellbore.

Downhole tool 600 further includes a ball seat 630 disposed within inner mandrel 620. Ball seat 630 is configured to slide within inner mandrel 620 during actuation cycles of downhole tool 600. An expandable ball seating surface 635 extends radially within ball seat 630. Ball seat 630 is configured to rotate within inner mandrel 620 on one or more pins 140, which slide within a ball seat jay slot (not shown), which was described above in detail. Expandable ball seating surface 635 is biased in a closed position with one or more springs 645.

During an actuation cycle of downhole tool 600, or other downhole tools deployed above or below downhole tool 600, one or more balls 690 may be used. Balls 690 employed may be formed from various materials and having varying diameters, based on the number of downhole tools 600 being actuated, the conditions of the wellbore, and the requirements of the drilling operation (e.g., softer materials may be used in drillable downhole tools 600). The term ball, within the meaning of the present disclosure, may include an object of any geometry capable of blocking a flow bore of a downhole tool or otherwise creating a pressure differential above and below the ball, while the ball is seating in, for example, a ball seat. While the ball 690 illustrated herein is shown having a round geometry, other geometries may be used. For example, in alternate embodiments, darts may be used.

As illustrated, ball seat 630 is biased in an axially upward position, such that expandable ball seating surface 635 creates a restriction though the central flow bore 615. Pressure from above the ball 690 causes the ball to push on expandable ball seating surface 635, which causes ball seat 630 to move axially downward. For perspective, referring back to FIG. 5, FIG. 6 represents downhole tool 600 as the one or more pins 640 are located within jay slot 555 between first slot position 565 and second slot position 570. In this position, the central flow bore 615 is restricted, but the ball seat 630 is moving axially downward within inner mandrel 620 due to the pressure applied from above ball 690.

Figure 7:
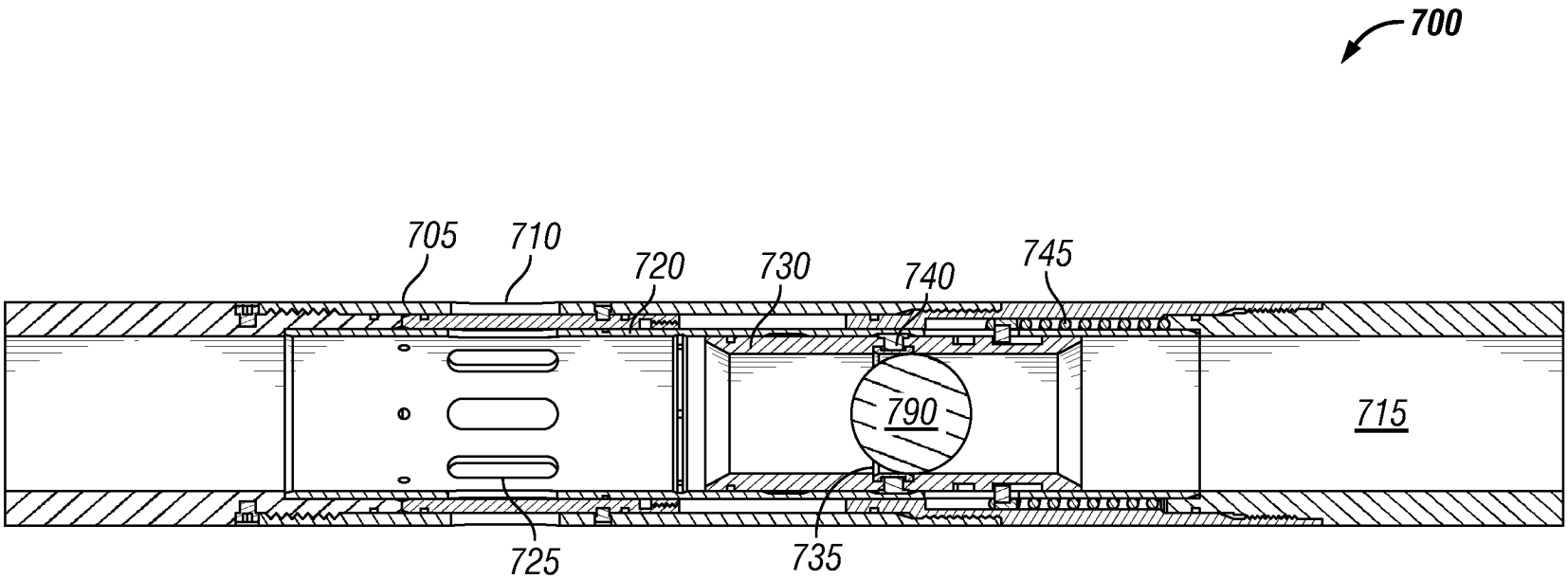
FIG. 7 is a cross-sectional view of a downhole tool according to embodiments of the present disclosure.

Now referring to FIG. 7, a cross-sectional view of a downhole tool 700 according to embodiments of the present disclosure is shown. In this embodiment, downhole tool 700 is shown as a ball 790 passes through a ball seat 730 during an actuation cycle.

As explained above with respect to downhole tool 600 of FIG. 6, downhole tool 700 has an outer housing 705 that includes a plurality of housing ports 710. Housing ports 710 provide fluid communication between a central flow bore 715 of downhole tool 700 and the wellbore (not independently shown). Downhole tool 700 also has an inner mandrel 720 disposed within outer housing 705. Inner mandrel 720 is configured to rotate within outer housing 705, thereby allowing downhole tool 700 to be actuated from a closed position (as shown), into an open, or frac ready position. Inner mandrel includes a plurality of mandrel ports 725 that when downhole tool 700 is in an open position, align with housing ports 710 of housing 705 to allow fluid communication between central flow bore 715 and the wellbore.

Downhole tool 700 further includes a ball seat 730 disposed within inner mandrel 720. Ball seat 730 is configured to slide within inner mandrel 720 during actuation cycles of downhole tool 700. An expandable ball seating surface 735 extends radially within ball seat 730. Ball seat 730 is configured to rotate within inner mandrel 720 on one or more pins 740, which slide within a ball seat jay slot (not shown), which was described above in detail.

In this embodiment, ball 790 has created a restriction in central flow bore 715, thereby causing ball seat 730 to slide axially downward within inner mandrel 720. As ball seat 730 slides axially downward, ball seat 730 rotates with respect to inner mandrel 720, as pins 740 slide along the ball seat jay slot. Referring also to FIG. 5 for perspective, downhole tool 700 represents the position of the pins 740 within the repeating jay slot 555 at second position 570.

In order to allow the ball 790 to pass through ball seat 730, as ball seat 730 slides axially downward within inner mandrel 720, expandable ball seating surface 730 is allowed to radially expand, sliding radially outward into a recess 795 on inner mandrel 720. The amount of radial expansion may depend on the specific design aspects of the tool, however, in certain embodiments, expandable ball seating surface 730 may be designed to radially expand about one inch. Such a radial expansion may thereby allow balls 790 of varying size to be used during actuation cycles of downhole tool 700.

Figure 8:
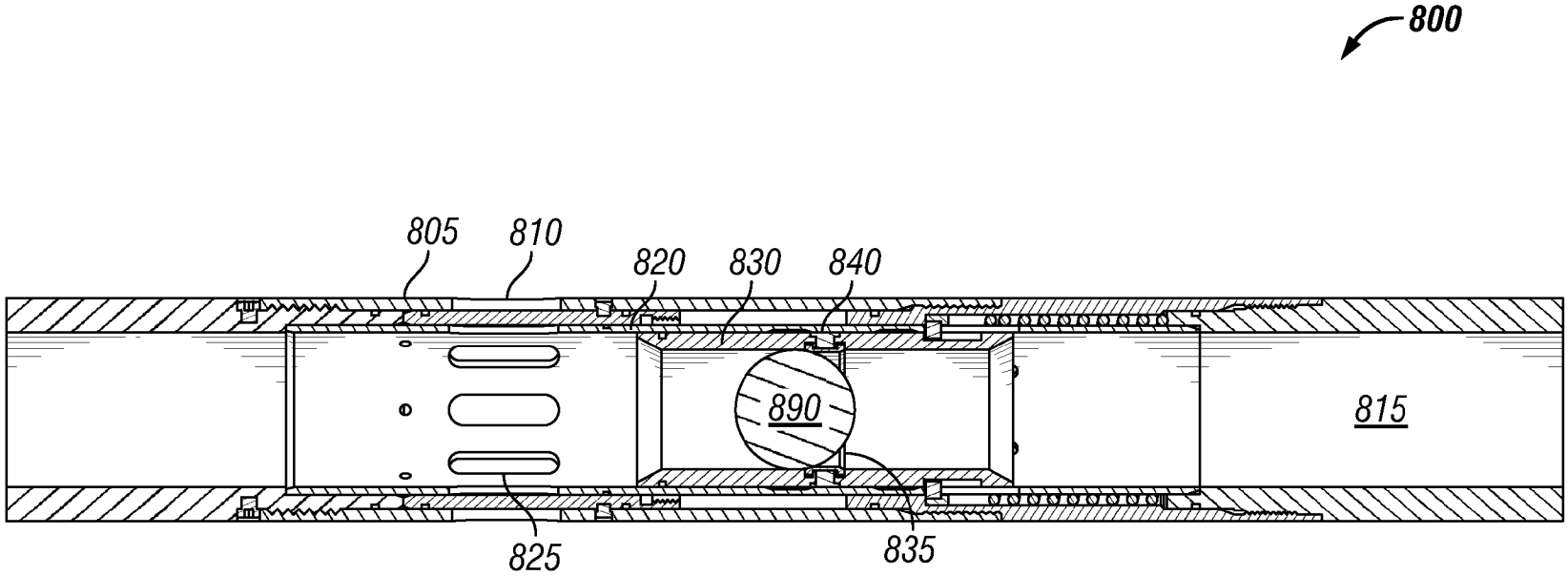
FIG. 8 is a cross-sectional view of a downhole tool according to embodiments of the present disclosure.

Referring to FIG. 8, a cross-sectional view of a downhole tool 800 according to embodiments of the present disclosure is shown. In this embodiment, downhole tool 800 is shown after a ball 890 has passed through a ball seat 830, and ball seat 830 has returned to a normal biased position. FIG. 8 is also representative of how downhole tool 800 may be configured as it is run in hole prior to any ball drops.

Downhole tool 800 has an outer housing 805 that includes a plurality of housing ports 810. Housing ports 810 provide fluid communication between a central flow bore 815 of downhole tool 800 and the wellbore (not independently shown). Downhole tool 800 also has an inner mandrel 820 disposed within outer housing 805. Inner mandrel 820 is configured to rotate within outer housing 805, thereby allowing downhole tool 800 to be actuated from a closed position (as shown), into an open, or frac ready position. Inner mandrel includes a plurality of mandrel ports 825 that when downhole tool 800 is in an open position, align with housing ports 810 of housing 805 to allow fluid communication between central flow bore 815 and the wellbore.

Downhole tool 800 further includes a ball seat 830 disposed within inner mandrel 820. Ball seat 830 is configured to slide within inner mandrel 820 during actuation cycles of downhole tool 800. An expandable ball seating surface 835 extends radially within ball seat 830. Ball seat 830 is configured to rotate within inner mandrel 820 on one or more pins 840, which slide within a ball seat jay slot (not shown), which was described above in detail.

As downhole tool 800 has progressed from having a ball 890 move ball seat 830 axially downward within inner mandrel 820, as illustrated in FIG. 7, ball seat 830 has slid axially upward within mandrel 820 in FIG. 8. Ball seat 830 returns to the position illustrated in FIG. 8 as a result of one or more (not shown) pushing axially upward on ball seat 830. For perspective, referring also to FIG. 5, one or more pins 840 of downhole tool 800 are in a repeating jay slot 555 in a slot position, such as first slot position 565, second slot position 575, or, for example, eleventh slot position 585. In this position, ball 890 has not yet started pushing down on expandable ball seating surface 835.

Figure 9:
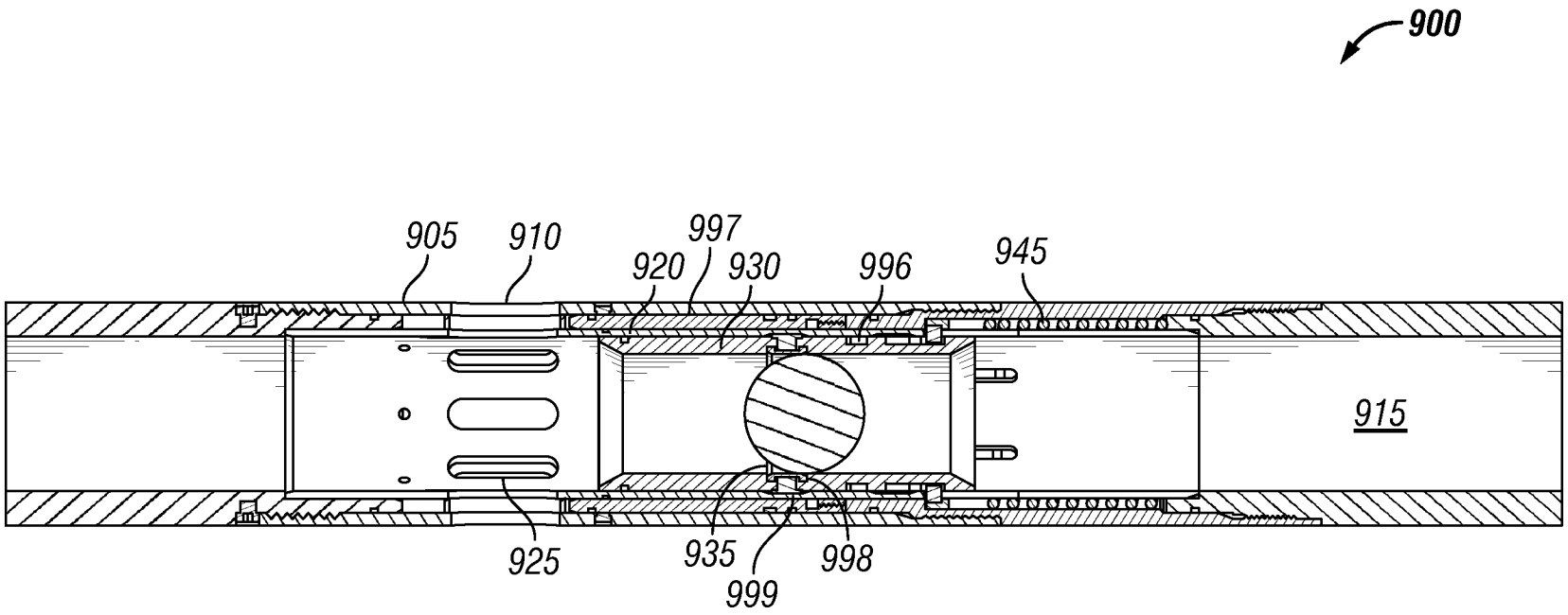
FIG. 9 is a cross-sectional view of a downhole tool according to embodiments of the present disclosure.

Referring to FIG. 9, across-sectional view of a downhole tool 900 according to embodiments of the present disclosure is shown. In this embodiment, downhole 900 has been actuated such that a plurality of housing ports 910 and a plurality of inner mandrel ports 925 are aligned, and downhole tool 900 is in a frac ready condition. FIG. 9 further illustrates how a ball 990 may be recirculated from lower in the wellbore in order to recover the ball 990.

Downhole tool 900 has an outer housing 905 that includes a plurality of housing ports 910. Housing ports 910 provide fluid communication between a central flow bore 915 of downhole tool 900 and the wellbore (not independently shown). Downhole tool 900 also has an inner mandrel 920 disposed within outer housing 905. Inner mandrel 920 is configured to rotate within outer housing 905, thereby allowing downhole tool 900 to be actuated from a closed position (FIGS. 1, 6, 7, and 8) into an open, or frac ready position (as shown). Inner mandrel includes a plurality of mandrel ports 925 that when downhole tool 900 is in an open position, align with housing ports 910 of housing 905 to allow fluid communication between central flow bore 915 and the wellbore. In the open position, hydraulic fracturing fluid may be pumped downhole in order to fracture formation, or alternatively, fluids, such as hydrocarbons, may be produced from the formation, flow through the central flow bore 915, and flow to the surface.

Downhole tool 900 further includes a ball seat 930 disposed within inner mandrel 920. Ball seat 930 is configured to slide within inner mandrel 920 during actuation cycles of downhole tool 900. An expandable ball seating surface 935 extends radially within ball seat 930. Ball seat 930 is configured to rotate within inner mandrel 920 on one or more pins 940, which slide within a ball seat jay slot (not shown), which was described above in detail.

As illustrated, one or more locks 996, such as a wicker, have engaged ball seat 930, thereby preventing ball seat 930 from moving axially lower within inner mandrel 920. In actuating downhole tool 900 into an open position, as currently illustrated, a ball 990 was dropped from the surface. Because the pins 940 had exited final slot position (580 of FIG. 5) and locks 996 engaged ball seat 930, the differential pressure difference above and below the ball pushed down causing piston 997 to move such that inner mandrel ports 925 align with outer housing ports 910.

FIG. 9 further illustrates the flow back of ball 990 from axially lower in the wellbore. As discussed above, locks 996 prevent ball seat 930 from moving axially downward within inner mandrel 920. However, ball seat 930 may move axially upward within inner mandrel. As pressure is applied below ball 990, ball 990 contacts a lower surface 998 of ball seat 930. Ball seat 930 moves axially upward within inner mandrel 920 causing expandable ball seating surface 935 to move into an upper recess 999. As expandable ball seating surface 935 moves within upper recess 999, the expandable ball seating surface 935 radially expands, thereby allowing ball 990 to pass through ball seat 930 and return to the surface of the well. Ball seat may then either remain in upper recess 999 or return to any position axially above lock 996.

Various types of downhole tools may use the actuation process disclosed according to embodiments of the present disclosure. While a hydraulic fracturing valves is explicitly disclosed above, examples of other tools include stage cementing valves, plug/isolation tools, packers, tubing conveyed perforating tools, easy rider perforating systems. This list is by way of example and illustration and is not limiting as the tool may be used with virtually any hydraulically actuated downhole tool.

Advantageously, embodiments of the present disclosure may provide downhole tools that increase the number of actuation cycles for a hydraulic fracturing operation. For example, a series of valves, each having a ball seat and/or expandable ball seating surface configured to engage a particular diameter ball may be run into a well bore. The valves may then be actuated in series, such that isolated sections of the well are hydraulically fractured independently.

In one embodiment, after a series of valves are placed at desired depths within a well, a specific diameter ball may be dropped and pass through multiple valves on the way down and only open the last valve in a given ball seat range. This may happen, for example five, seven, eleven, or more times for a particular well. As the ball passes through the valves, the valves are rotated through a repeating jay slot, locking the last valve in a given ball seat range into a frac ready position. Such a system may greatly increase the number of frac stages that may be achieved for a given well.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A downhole tool comprising:

an outer housing having a plurality of housing ports;

an inner mandrel disposed in the outer housing, the inner mandrel having a plurality of mandrel ports;

a ball seat disposed in the inner mandrel, the bail seat comprising an expandable ball seating surface and a jay slot: and a pin movable in and out of the jay slot, wherein, when the pin is moved out of the jay slot, the ball seat moves toward the plurality of mandrel ports, and the inner mandrel prevents the ball seating surface from expanding.

2. The downhole tool of claim 1, further comprising a spring disposed in the outer housing, wherein the spring biases the expandable ball seating surface into an expanded position.

3. The downhole tool of claim 2, wherein sliding the ball seat axially downward allows an inner diameter of the expandable ball seating surface to expand radially outward.

4. The downhole tool of claim 1, wherein the jay slot comprises at least six positions.

5. The downhole tool of claim 1, wherein moving the pin out of the jay slot engages a lock to the ball seat.

6. The downhole tool of claim 5, wherein engaging the lock prevents the ball seat from moving axially downward.

7. The downhole tool of claim 1, further comprising a biasing member disposed at least partially radially between the inner mandrel and the outer housing and engaging the ball seat, wherein the biasing member biases the ball seat axially toward the plurality of mandrel ports.

8. The downhole tool of claim 1, wherein the ball seat comprises first and second axial ends and a body extending therebetween, wherein the expandable ball seat extends radially through the body intermediate of the first and second ends.

9. The downhole tool of claim 8, wherein the expandable ball seat expands without deflecting the body of the ball seat.

10. The downhole tool of claim 1, further comprising a piston disposed at least partially radially between the inner mandrel and the outer housing, wherein the piston is movable from a first position, in which the piston is disposed between the plurality of mandrel ports and the plurality of housing ports, and a second position in which the piston is offset from the plurality of mandrel ports and the plurality of housing ports.

11. A method of actuating a downhole tool, the method comprising:

dropping a ball from a surface of a wellbore;

contacting the ball with a ball seat of the downhole tool, wherein the ball seat comprises a jay slot, and the downhole tool includes a pin received in the jay slot and an inner mandrel in which the ball seat is movably disposed;

moving the ball seat axially downward within the downhole tool, wherein moving the ball seat axially advances the pin in the jay slot;

expanding radially an expandable ball seating surface of the ball seat;

passing the ball through the expanded expandable ball seating surface;

moving the ball seat axially upward within the downhole tool, wherein moving the ball seat axially upwards advances the pin out of the jay slot, such that the ball seat is moved axially toward one or more mandrel ports formed radially in the inner mandrel, and the inner mandrel prevents the expandable ball seating surface from expanding after the ball seat is moved axially toward the one or more mandrel ports;

dropping a second ball from the surface of the wellbore; and contacting the second ball with the ball seat of the downhole tool, wherein the ball seat is prevented from moving axially downwards by one or more locks, such that the inner mandrel prevents the expandable ball seating surface from expanding.

12. The method of claim 11, further comprising:

creating a pressure differential across the ball seat when the second ball contacts the ball seat.

13. The method of claim 12, further comprising:

providing fluid communication between a central flowbore of the downhole tool and the wellbore by moving a piston in response to the pressure differential, the piston being disposed at least partially radially between the inner mandrel and an outer housing in which the inner mandrel is disposed.

14. The method of claim 11, further comprising;

flowing the ball from axially below the ball seat axially upward;

contacting the ball with a lower side of the bail seat;

moving the ball seat axially upward;

expanding the expandable ball seating surface of the bail seat; and passing the ball through the expanded expandable ball seating surface.

15. A method of fracturing formation, the method comprising:

disposing a first downhole tool to a first location within a wellbore, wherein the first downhole tool comprises a ball seat having a first diameter;

disposing a second downhole tool to a second location within the wellbore, wherein the second downhole tool comprises an expandable bail seat having the first diameter;

dropping a first ball from a surface of the wellbore;

passing the first ball through the second downhole tool, wherein passing the first ball through the second downhole tool comprises:

seating the first ball in the expandable ball seat of the second downhole tool;

sliding the expandable ball seat axially downward while rotating the expandable ball seat relative to an inner mandrel in which the expandable ball seat is disposed and relative to a pin in a jay slot of the expandable ball seat, such that the pin slides axially out of the jay slot;

expanding an expandable ball seating surface of the expandable ball seat, wherein, when the pin is out of the jay slot, a spring causes the expandable ball seat to move toward one or more mandrel ports defined at least partially radially through the inner mandrel, such that the inner mandrel prevents the expandable ball seat from expanding, and one or more locks prevent axial movement of the expandable ball seat away from the one or more mandrel ports;

seating the first ball in the ball seat of the first downhole tool;

opening a plurality of ports in the first downhole tool;

dropping a second ball from the surface of the wellbore after dropping the first ball;

seating the second ball in the expandable ball seat of the second downhole tool, wherein the inner mandrel prevents the expandable ball seat from expanding, thereby preventing the second ball from passing through the second downhole tool;

opening a plurality of ports in the second downhole tool; and fracturing the formation.

16. The method of claim 15, wherein the diameter of the first ball is larger than the diameter of the second ball.

17. The method of claim 15, further comprising:

disposing a third downhole tool to a third location within the wellbore, wherein the third downhole tool comprises a second expandable ball seat having a second diameter.

18. The method of claim 17, wherein the diameter of the ball seat of the first downhole tool is larger than the diameter of the expandable ball seat of the second downhole tool, and wherein the diameter of the expandable ball seat of the second downhole tool is larger than the diameter of the second expandable ball eat of the third downhole tool.

19. The method of claim 15, further comprising:

flowing the first ball from axially below the second downhole tool upward within the wellbore, after moving the pin out of the jay slot;

seating the first ball on the expandable ball seat of the second downhole tool;

moving the expandable ball seat axially upward while the pin remains out of the jay;

expanding radially the expandable ball seat; and returning the first ball through the expanded expandable ball seat to the surface of the wellbore.

20. The method of claim 15, wherein the jay slot has at least six slot positions in which the pin is positionable between axial movements of the expandable ball seat.

* * * * *

UNITED STATES PATENT AND TRADEMARK OFFICE

CERTIFICATE OF CORRECTION

PATENT NO. : 9,004,180 B2
APPLICATION NO. : 13/425413
DATED : April 14, 2015
INVENTOR(S) : Stephen L. Jackson It is certified that error appears in the above-identified patent and that said Letters Patent is hereby corrected as shown below:

In the Claims
Column 9, line 31: “bail seat” should read --ball seat--.
Column 10, line 49: “bail seat” should read --ball seat--.
Column 10, line 51: “surface of the bail” should read --surface of the ball--.
Column 10, line 62: “bail seat” should read --ball seat--.
Column 12, line 13: “ball eat” should read --ball seat--.

Signed and Sealed this
Eighteenth Day of August, 2015

Michelle K. Lee

Michelle K. Lee
*Director of the United States Patent and Trademark Office*